United States Patent [19]

Hogg

[11] 4,106,741

[45] Aug. 15, 1978

[54] TWO COMPONENT REMOVABLE ADHESIVE HANGER

[75] Inventor: James W. Hogg, Nashville, Tenn.

[73] Assignee: Anchor Wire Corporation of Tennessee, Goodletsville, Tenn.

[21] Appl. No.: 739,938

[22] Filed: Nov. 8, 1976

[51] Int. Cl.[2] ..... A47F 7/14

[52] U.S. Cl. ..... 248/467; 24/67 AR

[58] Field of Search ..... 248/467, 205 A; 24/67 AR; 428/40, 352

[56] References Cited

U.S. PATENT DOCUMENTS

| | | | |
|---|---|---|---|
| Re. 16,366 | 6/1926 | Jones | 24/67 AR |
| 2,574,152 | 11/1951 | Lewis | 428/40 |
| 2,724,568 | 11/1955 | Rabinovitch | 248/467 |
| 3,241,795 | 3/1966 | Frye | 248/467 |
| 3,275,469 | 9/1966 | Streit | 428/352 X |
| 3,409,257 | 11/1968 | Elm | 248/205 A |
| 3,504,844 | 4/1970 | Stark | 428/40 X |
| 3,620,366 | 11/1971 | Parkinson | 428/352 X |
| 3,633,865 | 1/1972 | Hogg | 248/467 |
| 3,885,768 | 5/1975 | Frye | 248/467 |
| 4,003,538 | 1/1977 | Frye | 248/467 |

*Primary Examiner*—Francis K. Zugel

[57] ABSTRACT

A two component removable adhesive hanger is disclosed which has a hook support component with a bifurcated end folded to form a pair of hook support legs and adhesively secured to a backing sheet component, the backing sheet component having adhesive means thereon to secure the hanger assembly to the wall, or similar surface. A hook member is supported by the hook support legs to enable the hanging of an article thereon. The backing sheet component extends downwardly beyond the hook support legs so as to provide an increased adhesive area and to prevent the hook from bearing directly against the surface to which the hanger is attached. The hanger is removable by manually separating the hook support component from the backing sheet component and subsequently dissolving the backing sheet by the application of water. Both the hook support component and the backing sheet component may be made from water dissolvable paper or the hook support component may be made from metal, plastic or like material.

16 Claims, 6 Drawing Figures

TWO COMPONENT REMOVABLE ADHESIVE HANGER

This application is related to U.S. Pat. No. 3,633,865 filed on Apr. 1, 1969 and issued to the applicant.

FIELD OF THE INVENTION

This invention relates to adhesive hangers, more particularly, such hangers which are capable of being removed without marring the surface to which they were attached.

SUMMARY OF PRIOR ART

Many attempts have been made in the past to provide hangers which may be secured to a wall without nails so as to avoid making holes in the walls, cracking plaster, or otherwise damaging the wall surface. Such hangers have also been sought in order to permit the hanging of objects on fragile surfaces, such as marble, glass or tile, which would be irreparably injured by conventional hangers using nails. None of the prior conventional adhesive hangers have proved commercially successful due to their many disadvantages, such as their inability to support objects substantially heavier than ten pounds, their inoperativeness with surfaces of glass, tile or water-base paint, and the difficulty in removal of the hangers from the surface without damaging the surface.

Conventional adhesive hangers generally have a loosely woven cloth backing which is impregnated with a water activable adhesive. One end of the adhesive backing is folded so as to form a hook support. To attach the hangers to a surface, the user moistens the adhesive cloth backing, places the hanger in position and waits for the adhesive to set. Such conventional, single component adhesive hangers are evidenced by the U.S. Pat. Nos. 2,647,711; 2,809,001; 3,052,436; 3,079,117; and 3,174,210 to Margulis, and U.S. Pat. No. 2,724,568 to Rabinovitch.

In order to remove most of these conventional, single component adhesive hangers from the surface to which they are attached, they are first moistened with water, and the adhesive cloth backing is peeled away from the wall. The single component adhesive hangers have not obviated the damage to the surface and oftentimes, the resultant damage is equal to, or worse than that caused by nails. This is because successful removal of the single component hanger is dependent upon the water penetrating the cloth backing, and each and every globule of glue. Since this rarely happens, some globules of glue remain attached to the wall and to the hanger. Thus, when the adhesive backing is stripped from the surface, it causes the cracking of plaster, and peeling and flaking of paint, paper and wallboard.

Two component adhesive hangers are also known, as evidenced by U.S. Pat. Nos. 3,241,795 and 3,885,768 to Frye. In the former patent, a backing sheet is applied to a smooth, imperforate surface, and a second, hanger supporting component is adhesively attached thereto. However, the backing sheet is not adhesively applied to the surface, but relies on a vacuum principle to remain on the surface when a load is applied thereto. This is disadvantageous for supporting loads for any length of time since air leakage gradually decreases the vacuum and, consequently, the holding power of the hanger.

In the latter patent, a two component, removable adhesive hanger is disclosed wherein a rigid, hook-supporting component is spot welded to a flexible backing sheet which is adhesively secured to a wall surface. To remove the hanger, the hook-supporting component is manually separated from the flexible backing sheet by breaking the welds and the flexible backing sheet is subsequently peeled from the wall surface. Obviously, the strength of the welds between the hook-supporting component and the flexible backing component determines the weight of the article which the hanger can support. If the welds are too small, the weight of the article suspended from the hook will cause them to break, while if the welds are too large. the spearation of the hook-supporting component from the flexible backing sheet cannot be accomplished, with the result that the flexible backing sheet will be manually torn from the wall, causing damage to the wall surface. Also, the known two component adhesive hanger has no facility for interlocking the hangers by applying one to the wall surface and one to the article to be supported thereon.

SUMMARY OF THE PRESENT INVENTION

The present invention discloses a two component removable adhesive hanger wherein a single piece wire hook member is pivotably supported on a hook support component which is adhesively secured to a backing sheet component. The hook is supported in the hook support component by forming a longitudinal slot near one end of such component and folding the end portion over so as to define legs which retain side portions of the hook member therein. The slot formed in the hook support component is dimensioned so as to allow the insertion of another hook therethrough, thus enabling two of the component adhesive hangers to interlock.

The backing sheet component is adhesively secured to a wall surface and the hook support component is adhesively secured to the backing sheet component. To remove the two component hanger, the hook support component is physically separated from the backing sheet component. Due to the larger adhesive contact area between the backing sheet component and the wall, and the smooth surface between the backing sheet component and the wall, which promotes intimate contact therebetween, the backing sheet component remains attached to the wall when the hook support component is separated therefrom. The adhesive bond between the hook support component and the backing sheet component removes the hard, smooth surface layer of the paper backing sheet component when the hook support component is removed, thereby exposing the fibers of the paper. Water is applied to the paper backing sheet to cause it to easily dissolve (since there is no slick water resistant surface of thick paperboard) and causing no damage to the wall surface.

Accordingly, it is an object of the present invention to utilize a paper backing in a two component adhesive hanger to permit easy and safe removal of the hanger.

Another object of the present invention is to utilize a wire hook member with an adhesive hanger such that the hook member can rotate to diametrically oppose the force of the object to be supported.

Another object of the invention is to provide a two component adhesive hanger having an increased adhesive area to attach the hanger to a wall or the like.

The present invention has another object in that a curved wire hook member is utilized in an adhesive hanger to prevent tearing of the support member under large loads and to dyanamically alter the curved supporting surface of the hook member within a fold in the support sheet.

Another object of the present invention is to utilize a wire hook member having a hook portion and two curved arms extending generally laterally therefrom such that loads applied to the hook portion tend to cause the arms to approach a straight configuration to prevent tearing of the hook support component of a two component adhesive hanger so as to enable it to support greater loads.

A further object of the present invention is to construct a two component, removable adhesive hanger with a paper backing sheet that may be easily disintegrated by lightly rubbing with water to remove that portion of the hanger from a surface without damage to the surface.

A further object of the present invention is to construct a two component adhesive hanger having a pair of double-thickness folded legs separated by a slot having an arcuate upper edge and a length less than that of the legs to reduce the tearing tendency in the hook support component and to facilitate manufacture of the hanger.

It is an additional object of the present invention to construct a two component removable adhesive hanger having an increased load capability without separating the components from each other, or from the wall surface to which it is attached due to an increased wall attachment area.

It is a further object to construct a two component removable adhesive hanger having uniformly distributed adhesion between the components so as to increase the load carrying ability of the hanger.

DETAILED DESCRIPTION OF THE PREFERRED EMBODIMENTS

Figure 1:
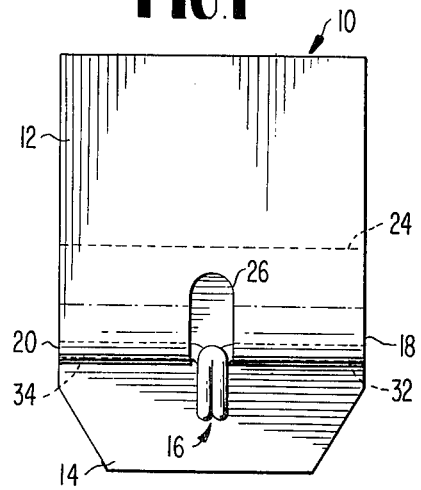
FIG. 1 is a front elevation of a first embodiment of a two component adhesive hanger according to the present invention.
Figure 2:
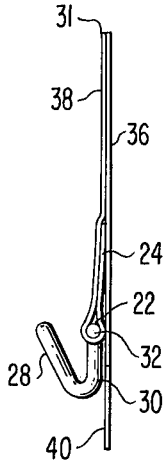
FIG. 2 is a side elevation of the two component adhesive hanger of FIG. 1.

A first embodiment of the two component removalbe adhesive hanger is indicated generally as 10 in FIG. 1 and includes a hook support component 12, a backing sheet component 14 and a hook member 16. The hook support component 12 is shown as being generally rectangular in shape, although it is understood that this particular shape is not necessary for the invention to function as described. The hook support component 12 is slotted and the end folded over to form hook support legs 18 and 20. Legs 18 and 20 are folded back over onto a portion of the hook support member 12 so as to form lateral openings 22, shown best in FIG. 2. The end portion of the bifurcated sections 24 is adhesively bonded to the rear side of the hook support component as shown in FIG. 2.

Hook member 16 has a hook portion 28 which is connected to shank portion 30 such that the two form an acute angle therebetween. The hook portion 28 and the shank 30 are formed of a double thickness of wire as shown in FIG. 1. Arms 32 and 34 extend laterally from the shank 30, each of the arms entering one of the openings 22 in the bifurcated legs 18 and 20. The openings 22 are dimensioned such that hook member 16 may pivot with respect to hook support component 12 along the axis of the arms.

The end portion of the hook support legs 18 and 20 extends upwardly beyond the end 26 of the slot between the hook support legs 18 and 20 to provide a reinforcement for this area. End 26 of the slot is preferably curved so as to minimize the stress concentrations and prevent tearing of the hook support component 12 when a load is placed on the hook member 16. Backing sheet component 14 is adhesively affixed to the rear portion of the hook support member 12 and extends downwardly beyond the extremity of the hook 28 and shank 30.

The hook support component 12 and the backing sheet component 14 may be made from any type of paper having the requisite strength and flexibility characteristics. Examples of such paper are kraft paper in either the bleached or unbleached varieties, paper board, and liner board-type paper having a thickness of approximately 0.006 inch or more. Extremely flexible paper of less thickness than the paper mentioned above that has the requisite strength and tear resistance is presently being developed for use in throwaway clothes, and such paper may be used with the present invention since any paper having flexibility, strength and tear resistance may be used, and the thinner the paper, the more easily it may be removed.

Alternatively, the hook support component 12 may be made from a more rigid material such as metal, plastic or the like. It is not necessary that the hook support component be water permeable since it is physically separated from the backing sheet component 14 during removal of the hanger from the wall. To add a decorative appearance, the metal or plastic material enables the hook support component 12 to be manufactured in various colors and textures.

The rear, exposed surface of backing sheet component 14 is indicated at 36, and is coated with a water-activated achesive for attaching the two component removable adhesive hanger to the wall surface, or the like. The adhesive may be any type of water-soluble adhesive such as animal adhesive, vegetable adhesive or combination animal-vegetable adhesive with the realization that animal adhesive is preferred due to its quicker set up time. The adhesive should be water-activated to permit easy installation of the adhesive hanger and water soluble to permit removal of the adhesive hanger from the surface after use.

The adhesive bonding the hook support component 12 to the backing sheet component 14 is weaker than that bonding the backing sheet 14 to the wall surface due to the larger surface area of the bond between the wall and the backing sheet component 14 and the more intimate contact therebetween. This enables the backing sheet component 14 to remain on the wall surface after the hook support component 12 has been manually separated therefrom. The manual separation is accomplished by gripping the hook member 16 along with the bifurcated hook support legs 18 and 20, and exerting an upward force thereon to tear the hook component 12 from the backing sheet component. The adhesive bonding the hook support component 12 to the backing sheet component 14 removes the relatively hard, water-resistant surface layer of the backing sheet component when the hook support component 12 is removed. Once the hook support component 12 has been removed, the fibers of the backing sheet component 14 are exposed, thereby enabling the complete disintegration of the backing sheet component 14 when it is placed into contact with water. Thus, the two component removable adhesive hanger may be completely removed from the wall surface without damaging it in any way.

The outer surface 38 of the hook support member 12 may be colored for aesthetic purposes with a thin, porous film of ink, such as water base flexographic ink, or by adhering a colored tape thereto. Similarly, the exposed portion 40 of the backing sheet component 14 could be colored, however, the colored backing on the backing sheet component 14 should not form a barrier that would prevent removal of the backing sheet from a wall. Thin film inks are removed from the backing sheet by rubbing and colored tapes are peeled from the backing prior to removal of the adhesive hanger from the surface.

The preferred method of coloring the two component hanger is to wet the adhesive of the hook support component 12 and the backing sheet component 14 on the side to be colored and apply a colored powder thereto. This may be done prior to assembling the components if desired. The powder floats to the surface of the adhesive to give the hanger the requisite color. Aluminum, or brass powder has been used successfully to give the finished hangers a metallic appearance. A particular advantage of this method is that the powder does not substantially inhibit the holding effect of the adhesive and, therefore, may be applied to the backing sheet component material and the hook support component material before they are formed or assembled without deleterious effects on the finished article. Animal glue and water have been found to be particularly useful in colored hangers.

Figure 3:
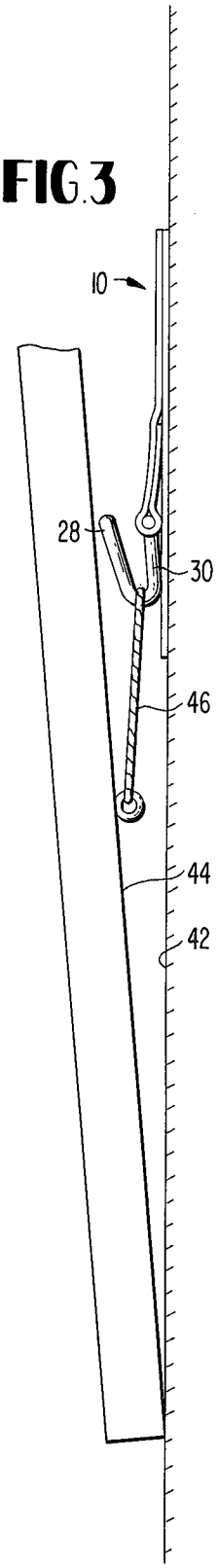
FIG. 3 is a side elevation of the two component adhesive hanger of FIG. 2 supporting an object on a wall.

Adhesive hanger 10 is illustrated in FIG. 3 secured to a wall surface 42 to support a picture 44 by wire 46 attached to the picture. The adhesive on the exposed surface 36 of backing sheet component 14 is moistened and hanger 10 is secured to wall 42 at the desired location. After the adhesive has dried, wire 46 is placed over hook 28 to rest at the bend between hook 28 and shank 30. Normally the bottom edge of the picture rests against the wall, and the picture exerts a force of hanger 10 through wire 46, tending to peel the hanger from the wall. This peeling force is minimized due to the construction of hanger 10 which disposes hook member 16 well below the portion of the hook support component 12 attached to the backing sheet component 14. Furthermore, hook member 16 is rotatable on an axis coinciding with arms 32 and 34 to permit the hook member to pivot toward the wall and diametrically oppose the forces from the picture. The pivoting of the hook member orients the load forces in a shearing plane generally parallel to the wall to prevent peeling. Any tearing action of the backing sheet component 14 from the wall surface is avoided by supporting the weight of the picture at a central point on the backing sheet component 14. The tendency of the force vector whch is perpendicular to the wall to peel the hanger from the wall is minimized by the longer backing sheet component 14 which places the vector in a generally central location on the backing sheet component. Thus, the force vector does not tend to pull away an edge of the hanger as with the prior art devices.

The portion of the backing sheet component 14 which extends downwardly beyond the extremities of the hook 28 and shank 30 prevents the hook member 16 from coming into contact with the wall at any time, thereby preventing the marring of the wall surface. Also, the backing sheet component 14 provides a certain cushioning effect to the hook 28, due to the compressibility of the paper, thereby minimizing the pivoting of the hook 28 about the contact point between it and the backing sheet which would tend to separate the hook support component 12 from the backing sheet component 14.

Figure 4:
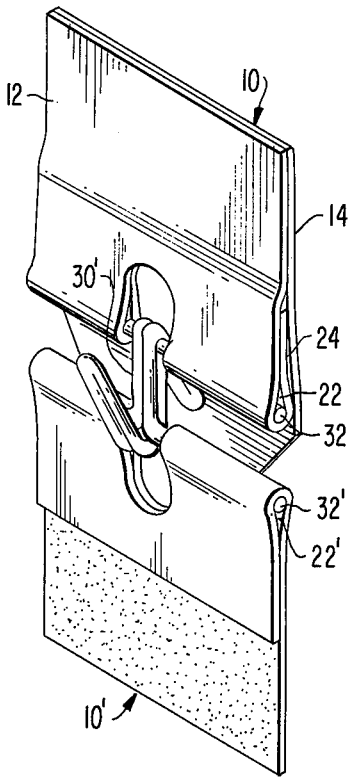
FIG. 4 is a perspective view of a two component adhesive hanger of FIG. 1 interlocking with a similar hanger from which the backing sheet has been removed for clarity.

The width of the slot between the bifurcated legs 18 and 20 is such as to allow the passage therethrough of hook 28' of another hanger 10'. By using two of the adhesive hangers 10 an object may be supported on a wall or other surface without wires or other hanging apparatus attached to the object. A first hanger 10 is secured to the wall and a second hanger 10' is secured in an inverted manner to the back of the object. The object is then hung by inserted hook 28' of hanger 10' through the slot of hanger 10, and hook 28 of hanger 10 through the slot in hanger 10' as shown in FIG. 4. The complementary interlocking of hangers 10 and 10' is very stable due to the use of the slots in the backing for receiving the hooks rather than slots or holes in the hook members themselves and, accordingly, twisting and turning of the object is prevented. The length of the slot in hanger 10 is determined by the length of hook 28 such that just enough space is provided to permit insertion and retraction of the hook member of another hanger 10' when the hangers are interlocked.

Figure 5:
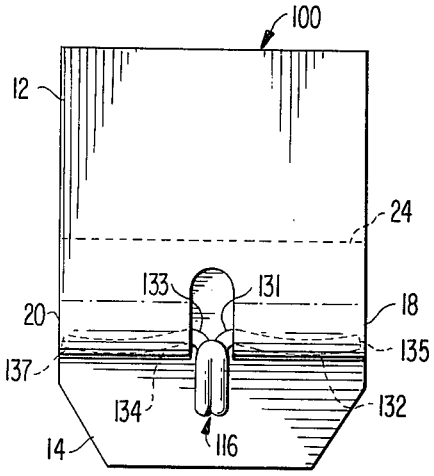
FIG. 5 is a front elevation of a second embodiment of a two component adhesive hanger according to the present invention.

A second embodiment of a two component removable adhesive hanger according to the present invention is illustrated in FIG. 5. Identical reference numbers are utilized to indicate parts identical to the adhesive hanger 10, shown in FIGS. 1–4, and reference numerals having a "1" prefix are utilized to indicate parts similar to parts of adhesive hanger 10.

The hook support component 12 with its associated bifurcated legs 18 and 29, and backing sheet component 14 have the same construction as previously described in reference to FIGS. 1–4, and no further description is believed to be necessary.

The second embodiment differs from the first embodiment in the shape of the hook member 116. Hook member 116 has the same hook and shank configuration as previously described, but arms 132 and 134, instead of being linear, as in the first embodiment (see arms 32 and 34), the arms are curved, as shown in FIG. 5, such that knees 131 and 133 are formed where the arms 132 and 134 join with the shank of the hook member 116. The portion of the arms 132 and 134 adjacent the knees 131 and 133, respectively, are not in contact with the bottom of the folded, bifurcated support legs 18 and 20. The ends 135 and 136 of arms 132 and 134, respectively, are also bent slightly upeard so as not to be in contact with the bottom of legs 18 and 20.

The curvature of the arms 132 and 134 provides increased reliability and strength and also resists the tearing of the hook support component 12. When a load is applied to hook member 116, the support for holding the load is derived from the folded bottom of support legs 18 and 20, which engages the arms of the hook member. The curved arms 132 and 134 of hook member 116 permit the forces holding the load to be located in the lateral center of the folds where the curved bottom portions of the arms are in contact with the support legs 18 and 20. This prevents extreme forces being located at either lateral edge of the support legs 18 and 20 so as to prevent tearing thereof.

The knees 131 and 133 of hook member 116 will be deformed and pulled down under large loads such that any tearing of the edges is completely avoided for light loads, and for heavier loads any tendency to tear at the outer edges of legs 18 and 20 is avoided. The tendency to tear at the lateral inner edges of legs 18 and 20 is also reduced due to the even deformation of the wire hook member 116 under large loads. Furthermore, the deformation of the arms will provide greater support surface to distribute the load along the fold and prevent any destructive bearing points from being formed.

The two component adhesive hanger 100 has the same hook pivoting action as adhesive hanger 10 previously discussed in regard to the embodiments shown in FIGS. 1–4, to diametrically oppose the load forces imposed thereon, and a pair of hangers 100 may be used in interlocking cooperation in the same manner as the hangers 10 and 10′ shown in FIG. 4.

Figure 6:
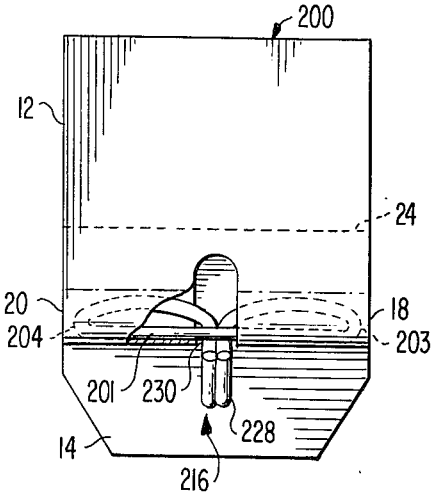
FIG. 6 is a front elevation of a third embodiment of a two piece adhesive hanger according to the present invention.

A third embodiment of a two component removable adhesive hanger 200 according to the present invention is illustrated in FIG. 6. Identical reference numbers are utilized to identify parts identical to parts of the adhesive hanger 10 and reference numerals with a "2" prefix are utilized to indicate parts similar to parts of adhesive hanger 10.

The hook support component 12 and the backing sheet component 14 of hanger 200 are composed of similar material and are adhesively bonded together in the same fashion as described in regard to the embodiment of FIG. 1 insofar as the configuration of hook member 216 is concerned.

The wire hook member 216 utilized with hanger 200 is formed by bending a single length of wire such that the ends of the wire terminate at the upper edge of hook 228 rather than at the outer edges of the support legs 18 and 20 as in the previously discussed embodiments. The support portion of hook member 216 includes a member 201 extending substantially across the entire width of hook support component 12 through the slots 22 in support legs 18 and 20. The hook member also includes looped arms 203 and 204 disposed in slot 22 through support legs 18 and 20, respectively. Looped arms 203 and 204 are bent from the outer ends of member 201 behind member 201 to form a shank 230.

The angular relationship of shank 230 and hook 228 is similar to that described with regard to hook 38 and shank 30. The shape of the portion of hook member 216 serves to prevent tearing of the lateral edges of support legs 18 and 20 by supporting the load forces through the looped arms 203 and 204 such that the force of member 201 is evenly distributed along the folds of the support legs 18 and 20. Since member 201 extends for almost the entire width of the hook support component 12, maximum support is derived therefrom. When large loads are applied to hook member 216, the looped arms 203 and 204 will be slightly deformed under the force of the load and prevent any undue forces on member 201 which would cause an uneven distribution of forces and subsequent tearing of the support legs 18 and 20. The lateral inner edges of support legs 18 and 20 are not subject to tearing because the load forces are applied directly to the looped arms, rather than to the portion of member 201 extending across the slot between the legs.

A pair of adhesive hangers 200 may be used in interlocking cooperation in the same manner as described with respect to hanger 10 and 10′ shown in FIG. 4.

It is envisioned that the embodiments previously described for a two component removable adhesive hanger will be fabricated by the method described hereinafter. A supply roll of paper material to form the hook support component 12 is fed into a first die which punches a slot adjacent one end, which slot later forms the slot between the bifurcated leg portions 18 and 20. In the preferred embodiment, the supply roll of paper material is purchased having a water soluble adhesive on both sides. Alternatively, however, the adhesive may be applied to a plain paper material as it is unwound from the supply roll before it enters the first die. Next, the hook member, which has been previously formed to any of the desired shapes, is placed onto the hook support component 12 such that the shank and hook portion extend through the punched out slot. Water is sprayed on a portion of the bifurcated legs, and each leg is subsequently folded over the arms of the hook member and bonded to the rear surface of the hook support component 12, thereby affixing the hook member thereto. Additional pressure and heat may be applied to the hook support component 12 in the area adjacent the slot to insure complete bonding between the bifurcated legs and the hook support component. The hook support component 12 is then cut to final shape, such as by a die, and, after moistening the adhesive on the rear portion thereof it is bonded to the backing sheet component 14, which has been previously cut to a similar shape and has a layer of water soluble adhesive thereon. The hanger is then ready for packaging.

While the invention has been described in its preferred form, it is not limited to the exact structures illustrated as various changes and modifications may be made without departing from the scope of the appended claims.

What is claimed is:

1. A two component removable adhesive hanger for hanging an object on a wall or like surface comprising:
   (a) a hook member support component;
   (b) a hook member supported by said hook member support component; and
   (c) a backing sheet component of fibrous, water dissolvable material adhesively bonded to the hook member support component by a first adhesive, said backing sheet component having a water activated and water dissolvable second adhesive on the side which is affixed to the wall or like surface wherein the bonds created by said first and second adhesives are of greater strength than that of the fibrous material such that upon removal of said hook member support component from said backing sheet component, a portion of the backing sheet component remains attached to said hook member support component and a portion remains attached to said wall or like surface, which portion attached to said wall is dissolvable upon contact with water.

2. The two component removable adhesive hanger layer of claim 1 wherein said backing sheet component is made from paper.

3. The two component removable adhesive hanger of claim 2 wherein said paper is kraft paper board having a thickness of at least 0.006.

4. The two component removable adhesive hanger of claim 2 wherein said hook support component is made from paper.

5. The two component removable adhesive hanger of claim 4 wherein said paper is kraft paper.

6. The two component removable adhesive hanger of claim 2 wherein said hook support component is made of metal.

7. The two component removable adhesive hanger of claim 2 wherein said hook support component is made of plastic.

8. The two component removable adhesive hanger of claim 1 wherein the second adhesive on said backing sheet component is an animal adhesive.

9. The two component removable adhesive hanger of claim 1 wherein the second adhesive on said backing sheet component is a vegetable adhesive.

10. The two component removable adhesive hanger of claim 1 wherein the second adhesive on said backing sheet component is a combination animal-vegetable adhesive.

11. The two component removable adhesive hanger of claim 1 wherein the slotted end portion is folded back and adhesively bonded to the back of the hook support component to thereby define a pair of hook supporting legs having coaxial, laterally extending openings therethrough.

12. The two component removble adhesive hanger of claim 11 wherein the hook member comprises:

(a) a shank portion;

(b) a hook portion integral with said shank portion and forming an acute angle therewith; and (c) a pair of laterally extending arms formed integrally with said shank, one of the amrs extending substantially through each laterally extending opening in the hook supporting legs.

13. The two component removable adhesive hanger of claim 12 wherein the laterally extending arms are straight and coaxial.

14. The two component removable adhesive hanger of claim 12 wherein each of the laterally extending arms has an upwardly curved knee portion adjacent the shank, the knee portions being out of contact with the bottom of the hook supporting legs, the remaining portion of each arm being curved in the reverse direction such that each end is out of contact with the bottom of hook supporting legs.

15. The two component removable adhesive hanger of claim 12 wherein said hook member is formed from a single wire having a linear member extending substantially through both openings in the hook support legs and the pair of arms from a loop with the linear member and said shank.

16. The two component removable adhesive hanger of claim 1 wherein the distance between the hook supporting legs is greater than the width of the hook portion so as to allow the passage of the hook portion of another two component removable adhesive hanger therethrough, thereby enabling a pair of hangers to interlock to support an article on a wall or the like.

* * * * *